US008077139B2

(12) United States Patent
Chang et al.

(10) Patent No.: US 8,077,139 B2
(45) Date of Patent: Dec. 13, 2011

(54) DRIVING CIRCUIT OF BACKLIGHT MODULE

(75) Inventors: Shih-Meng Chang, Taipei County (TW); Chia-Lin Liu, Taichung County (TW); Chi-Neng Mo, Taoyuan County (TW); Ke-Horng Chen, Taipei County (TW); Chi-Lin Chen, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 386 days.

(21) Appl. No.: 12/497,542

(22) Filed: Jul. 2, 2009

(65) Prior Publication Data

US 2010/0265271 A1 Oct. 21, 2010

(30) Foreign Application Priority Data

Apr. 16, 2009 (TW) ..... 98112685 A

(51) Int. Cl.
*G09G 3/36* (2006.01)

(52) U.S. Cl. ..... 345/102; 315/185; 315/192; 315/291

(58) Field of Classification Search ..... 345/102, 345/211, 212; 315/185, 192, 246, 297, 291, 315/307

See application file for complete search history.

(56) References Cited

U.S. PATENT DOCUMENTS

| | | | | |
|---|---|---|---|---|
| 8,018,170 | B2 * | 9/2011 | Chen et al. | 315/192 |
| 2007/0114951 | A1 * | 5/2007 | Tsen et al. | 315/291 |
| 2007/0222739 | A1 * | 9/2007 | Yu et al. | 345/102 |

* cited by examiner

*Primary Examiner* — Amare Mengistu
*Assistant Examiner* — Koosha Sharifi-Tafreshi
(74) *Attorney, Agent, or Firm* — Jianq Chyun IP Office

(57) ABSTRACT

A driving circuit of a backlight module is provided. The driving circuit has a dimming unit used for transmitting signals, wherein the dimming unit can adjust a current flowing through a light-emitting diode (LED) according a pulse width modulation signal and an enable signal, so as to adjust a light-emitting intensity of the LED. In the present invention, fewer devices are used to implement the dimming unit, and a transmission gate is replaced by a N-type transistor and a P-type transistor, such that a chip area and a circuit cost of the driving circuit are reduced.

9 Claims, 2 Drawing Sheets

DRIVING CIRCUIT OF BACKLIGHT MODULE

CROSS-REFERENCE TO RELATED APPLICATION

This application claims the priority benefit of Taiwan application serial no. 98112685, filed Apr. 16, 2009. The entirety of the above-mentioned patent application is hereby incorporated by reference herein and made a part of specification.

BACKGROUND OF THE INVENTION

1. Field of the Invention

The present invention relates to a driving circuit of a light emitting diode (LED). More particularly, the present invention relates to a driving circuit with a low cost.

2. Description of Related Art

An energy-saving concept is highlighted due to a global warming issue, so that designs of computer related equipments are also in accordance with the energy-saving concept. Since application of a light-emitting diode (LED) backlight module can reduce power consumption, and reduce a product size and generation of heat, the electronic product can be light and slim. Therefore, LEDs are widely applied to the backlight modules of displays.

A driving circuit of the LED backlight module generally includes a boost circuit and a dimming circuit, wherein the boost circuit is mainly used to convert an input voltage and provide a driving voltage for the LED backlight module, and the dimming circuit is used for adjusting a conducted current of the LED. The LED backlight module includes a plurality of LED strings, and each of the LED strings is composed of a plurality of LEDs connected in serial. A luminance of the LED is proportional to the conducted current, and the dimming circuit is used for adjusting a light-emitting intensity of the LED string.

The dimming circuit receives a pulse width modulation (PWM) signal and an enable signal, and adjusts the conductive current of the LED string according to the PWM signal and the enable signal. However, in a high-class electronic product, to even the light-emitting intensity of each LED string, multiple adjusting circuits have to be applied, and a large number of transmission gates are used for signal transmission. Therefore, not only a complexity of a circuit design is increased, a chip area is also increased, so that a cost of the device is increased.

SUMMARY OF THE INVENTION

The present invention is directed to a driving circuit of a light-emitting diode (LED), in which a combination of transistors are used to replace transmission gates, so that a chip area and a design cost of the driving circuit can be reduced.

The present invention provides a driving circuit of a backlight module, wherein the backlight module includes a LED unit, and the driving circuit includes a voltage conversion unit, a current adjusting unit, a current mapping unit and a dimming unit. The voltage conversion unit is coupled to a first end of the LED unit for providing a driving voltage to the LED unit. The current adjusting unit is coupled to a second end of the LED unit for adjusting a conducted current of the LED unit according to a current adjusting signal. The dimming unit is coupled between the current mapping unit and the current adjusting unit, and includes a plurality of driving units, wherein a first driving unit outputs the current adjusting signal to the current adjusting unit according to a pulse width modulation (PWM) signal, an enable signal and a reference voltage output by the current mapping unit. Wherein, the first driving unit includes an AND gate, a N-type transistor and a P-type transistor. Input terminals of the AND gate respectively receive the PWM signal and the enable signal. A drain of the N-type transistor is coupled to the reference voltage, a source thereof is coupled to the current adjusting unit and generates the current adjusting signal, and a gate thereof is coupled to an output terminal of the AND gate. The P-type transistor is coupled between the reference voltage and ground, and a gate of the P-type transistor is coupled to the output terminal of the AND gate.

In an embodiment of the present invention, the backlight module further includes a plurality of LED units respectively coupled between the voltage conversion unit and the current adjusting unit. The driving units respectively output the current adjusting signal to the current adjusting unit according to the corresponding PWM signal, the enable signal and the reference voltage, so as to adjust the conducted currents of the LED units.

In an embodiment of the present invention, the current adjusting unit includes a first N-type transistor, a second N-type transistor, a comparator and a third N-type transistor. A drain of the first N-type transistor is coupled to the second end of the LED unit, and a source of the first N-type transistor is coupled to a drain of the second N-type transistor. A source of the second N-type transistor is coupled to the ground, and a gate thereof is coupled to the driving unit. A positive input terminal of the comparator is coupled to a reference voltage, a negative input terminal thereof is coupled to a drain of the third N-type transistor, and an output terminal of the comparator is coupled to a gate of the first N-type transistor. A source of the third N-type transistor is coupled to a common node of the first N-type transistor and the second N-type transistor, and a gate of the third N-type transistor is coupled to the drain of the third N-type transistor.

In an embodiment of the present invention, the driving circuit further includes a voltage detecting unit coupled between the second end of the LED unit and the voltage conversion unit, which is used for detecting a voltage of the second end of the LED unit, so as to adjust the driving voltage output by the voltage conversion unit.

In an embodiment of the present invention, the current mapping unit includes a first P-type transistor, a second P-type transistor, a first N-type transistor, a resistor and a comparator. Wherein, a source of the first P-type transistor is coupled to a voltage source, and a gate of the first P-type transistor is coupled to a drain of the first P-type transistor. A source of the second P-type transistor is coupled to the voltage source, a drain of the second P-type transistor is coupled to the ground, and a gate of the second P-type transistor is coupled to the gate of the first P-type transistor. A drain of the first N-type transistor is coupled to the drain of the first P-type transistor. The resistor is coupled between a source of the first N-type transistor and the ground. A positive input terminal of the comparator is coupled to a reference voltage, a negative input terminal of the comparator is coupled to the source of the first N-type transistor, and an output terminal of the comparator is coupled to a gate of the first N-type transistor. Wherein, the first P-type transistor and the second P-type transistor form a current mirror, and the gate of the first P-type transistor outputs the reference voltage.

In summary, the present invention provides a driving circuit of a backlight module, in which fewer devices are used to implement the dimming unit, and transmission gates are replaced by a N-type transistor and a P-type transistor, such that a chip area and a circuit cost of the driving circuit are reduced.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
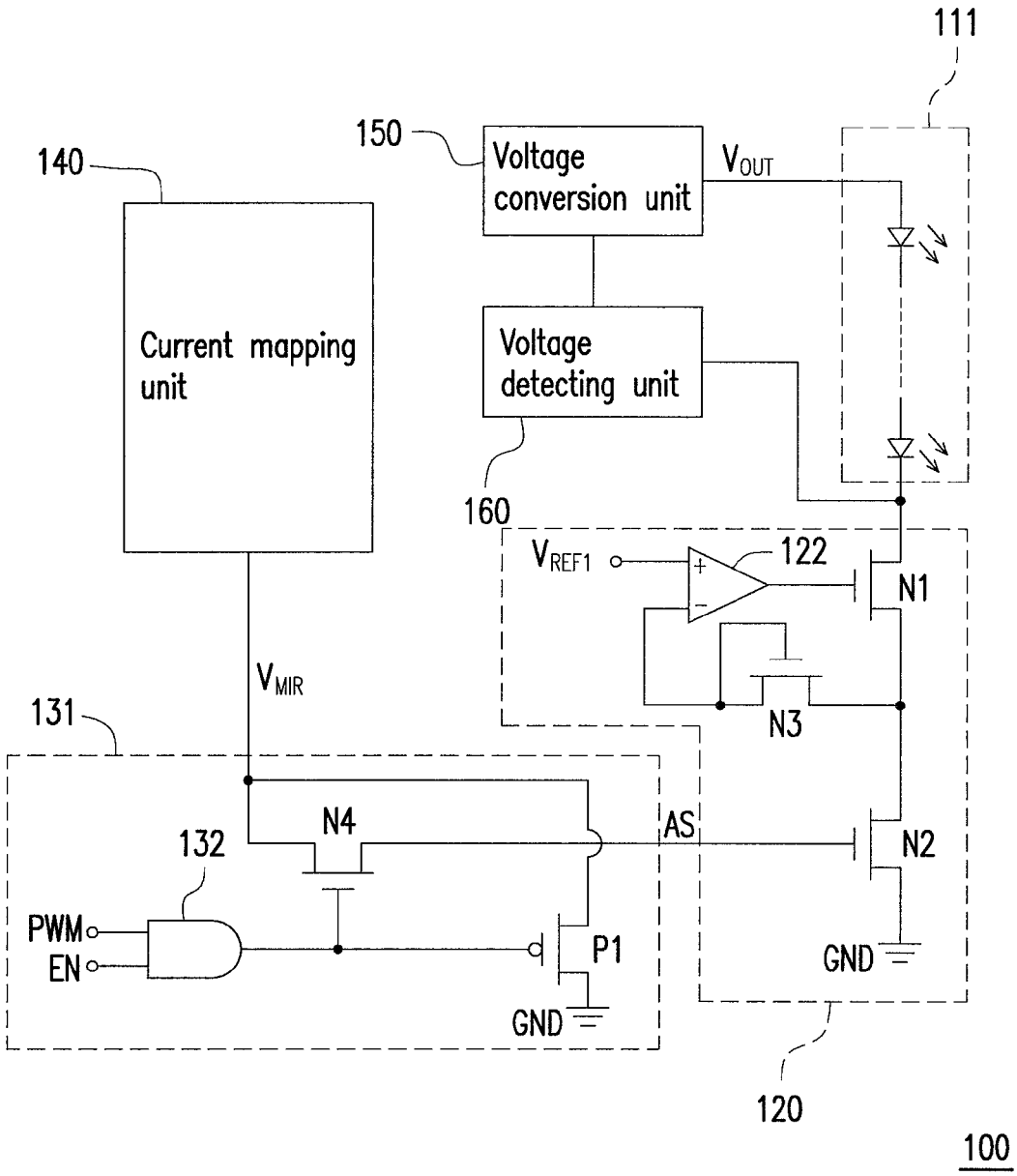
FIG. 1 is a diagram illustrating a driving circuit of a backlight module according to an embodiment of the present invention.

Referring to FIG. 1, FIG. 1 is a diagram illustrating a driving circuit of a backlight module according to an embodiment of the present invention. The driving circuit 100 includes a current adjusting unit 120, a driving unit 131, a current mapping unit 140, a voltage conversion unit 150 and a voltage detecting unit 160. The driving circuit 100 is coupled to one end of a backlight module (including a light-emitting diode (LED) unit 111), and another end of the LED unit 111 is coupled to the current adjusting unit 120 and the voltage detecting unit 160, wherein the LED unit 111 is composed of a plurality of LEDs connected in serial. The current mapping unit 140 is coupled to the driving unit 131, and another end of the driving unit 131 is coupled to the current adjusting unit 120.

The voltage conversion unit 150 provides a driving voltage $V_{OUT}$, to one end of the LED unit 111, and the voltage detecting unit 160 detects a voltage value on the other end of the LED unit 111 for determining whether a voltage difference at two ends of the LED unit 111 is equal to a predetermined value, so as to adjust the driving voltage $V_{OUT}$, output by the voltage conversion unit 150. Based on the voltage conversion unit 150, the LED unit 111 can maintain a stable bias and a desired light-emitting intensity.

The current adjusting unit 120 is coupled to the other end of the LED unit 111, and a circuit structure thereof is as that shown in FIG. 1. The current adjusting unit 120 includes N-type transistors N1, N2 and N3, and a comparator 122. The N-type transistors N1 and N2 are coupled in serial between the LED unit 111 and the ground GND. A gate of the N-type transistor N1 is coupled to an output terminal of the comparator 122, and a gate of the N-type transistor N2 is coupled to the driving unit 131 for receiving a current adjusting signal AS. The N-type transistor N3 is coupled between a common node of the N-type transistors N1 and N2 and a negative input terminal of the comparator 122, and a gate of the N-type transistor N3 is coupled to a drain of the N-type transistor N3. A positive input terminal of the comparator 122 is coupled to a reference voltage $V_{REF1}$. The comparator 122 and the N-type transistor N3 are used for detecting whether the LED unit 111 is short-circuited or open-circuited, so as to adjust a conducting state of the N-type transistor N3. When the LED unit 111 is short-circuited, the comparator 122 turns off the N-type transistor N1 to protect the driving circuit 100.

The current adjusting unit 120 can adjust a conducted current of the N-type transistor N2 according to the received current adjusting signal AS, wherein the greater the current adjusting signal AS is, the higher the conducted current of the N-type transistor N2 is. The driving unit 131 generates the current adjusting signal AS according to a pulse width modulation (PWM) signal PWM, an enable signal EN and a reference voltage $V_{MIR}$, output by the current mapping unit 140.

The current mapping unit 140 mainly includes a current mirror circuit (not shown in FIG. 1), and is used for outputting the reference voltage $V_{MIR}$, (i.e. a reference voltage used for mapping a current in the current mirror). The driving unit 131 includes an AND gate 132, a N-type transistor N4, and a P-type transistor P1, wherein the N-type transistor N4 is coupled between the reference voltage $V_{MIR}$, and the gate of the N-type transistor N2, and the P-type transistor P1 is coupled between the reference voltage $V_{MIR}$, and the ground GND. Two input terminals of the AND gate 132 respectively receives the PWM signal PWM and the enable signal EN, and an output terminal of the AND gate 132 is coupled to gates of the N-type transistor N4 and the P-type transistor P1. When the enable signal EN is enabled (logic high level), a conducting time of the N-type transistor N4 is adjusted according to a duty cycle of the PWM signal PWM, so as to transmit the reference voltage $V_{MIR}$, (i.e. the current adjusting signal AS) to the N-type transistor N2. Thereafter, the N-type transistor N2 maps the current mapping unit 140 to conduct a corresponding current. When the enable signal EN is disabled, the P-type transistor P1 is conducted to pull down the reference voltage $V_{MIR}$, to a low level (which is closed to the ground level).

Therefore, the conducted current of the LED unit 111 can be adjusted according to the PWM signal PWM and the enable signal EN, so as to adjust the light-emitting intensity of the LED unit 111. Moreover, in another embodiment, the N-type transistor N3 in the current adjusting unit 120 can be replaced by a resistor (not shown). Since a main function of the N-type transistor N3 is to avoid excessive current generated on a feedback path, it can be replaced by the resistor, by which a function of decreasing a feedback current can also be achieved. Moreover, when the N-type transistor N3 is worked in a saturation region, it can be regarded as a small resistor (1/gm, wherein gm is a transconductance) in case of a small signal analysis. Considering a body effect, a whole impedance of the N-type transistor N3 can be smaller (1/(gm+gmb), wherein gmb is a body transconductance). Since the conducted current of the N-type transistor N3 can be varied along with a temperature variation to generate a smaller resistance, the reference voltage $V_{REF1}$, can totally fall on the common node of the N-type transistors N1 and N2.

During application of a liquid crystal display (LCD), the backlight module generally includes a plurality of LED units, and the aforementioned driving circuit 100 can also be used to drive the backlight module having a plurality of the LED units. A circuit structure of the driving circuit 100 is shown in FIG. 2, FIG. 2 is a diagram illustrating a driving circuit of a backlight module according to another embodiment of the present invention.

Figure 2:
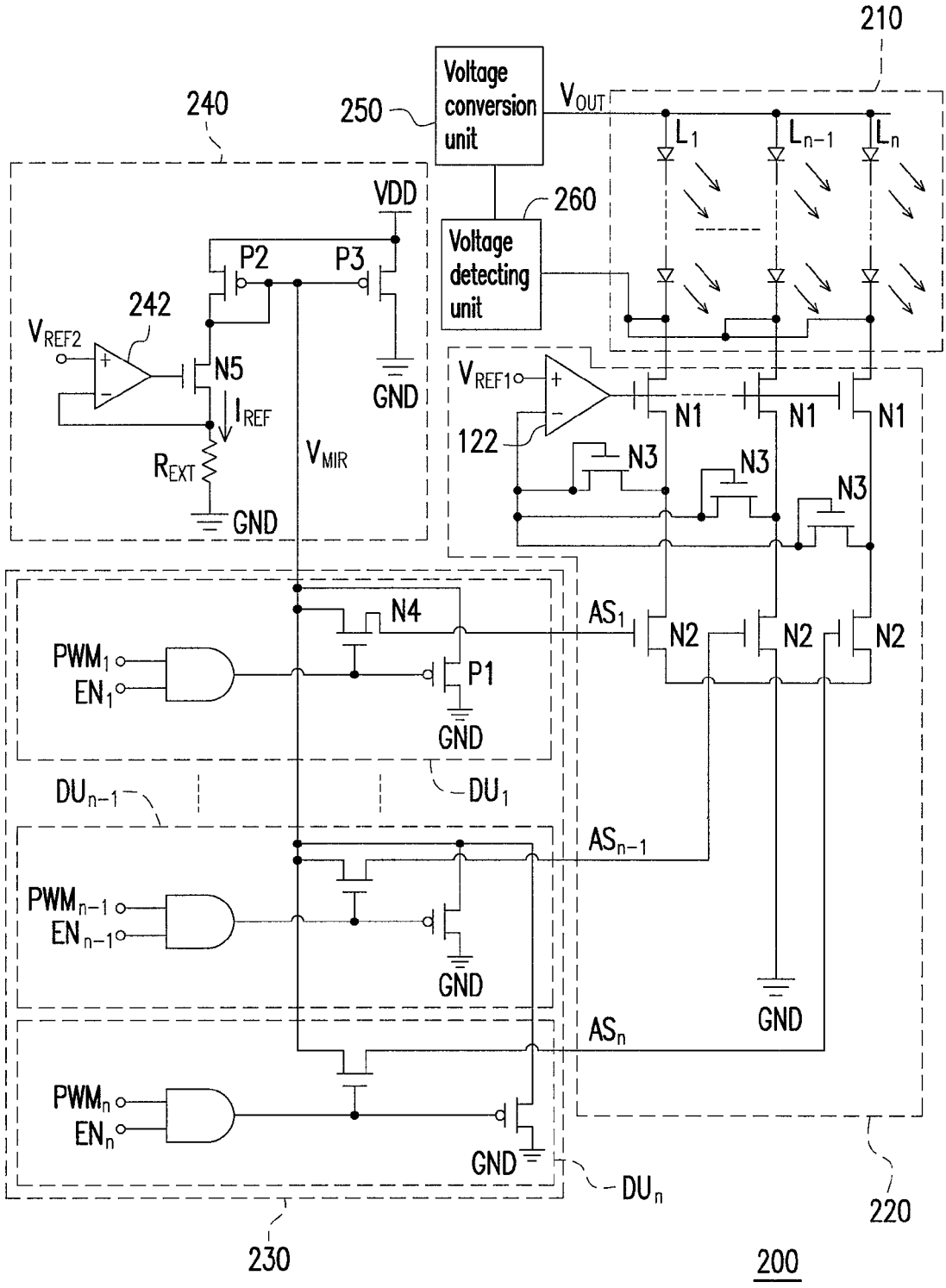
FIG. 2 is a diagram illustrating a driving circuit of a backlight module according to another embodiment of the present invention.

A main difference between FIG. 2 and FIG. 1 is that a backlight module 210 includes a plurality of LED units $L_1$-$L_n$, (n is a positive integer), and in a current adjusting unit 220, N-type transistors N1-N3 are configured for corresponding to each of the LED units $L_1$-$L_n$, (as shown in FIG. 2), though the same comparator 122 is commonly used. A dimming unit 230 includes a plurality of driving units $DU_1$-$DU_n$, wherein the driving units $DU_1$-$DU_n$, respectively receive PWM signals $PWM_1$-$PWM_n$, and enable signals $EN_1$-$EN_n$.

The driving units $DU_1$-$DU_n$, of the dimming unit 230 one-by-one correspond to the LED units $L_1$-$L_n$, and respectively output current adjusting signals $AS_1$-$AS_n$, to the current adjusting unit 220 according to the PWM signals $PWM_1$-$PWM_n$, and the enable signals $EN_1$-$EN_n$, so as to respectively adjust the conducted currents of the LED units $L_1$-$L_n$.

It should be noticed that circuit structures of the driving units $DU_1$-$DU_n$, of FIG. 2 are the same, and only the received PWM signals and enable signals are different, so that operations of the driving units $DU_1$-$DU_n$, are the same to that of the driving unit of FIG. 1, and therefore detail descriptions thereof are not repeated. Moreover, comparing the current adjusting unit 220 and the current adjusting unit 120, the current adjusting unit 220 applies the same comparator 122 to detect open-circuit states of all of the LED units $L_1$-$L_n$, and the transistors N1-N3 corresponding to each of the LED units $L_1$-$L_n$, are duplicated according to a same circuit structure, which can be easily deduced by those skilled in the art according to a disclosure of the present invention, and therefore detail descriptions thereof are not repeated.

The current mapping unit 240 includes P-type transistors P2 and P3, a N-type transistor N5, a resistor $R_{EXT}$, and a comparator 242. Drains of the P-type transistors P2 and P3 are coupled to a voltage source VDD, and gates thereof are mutually coupled to form a current mirror. The N-type transistor N5 is coupled between the P-type transistor P2 and the resistor $R_{EXT}$, and another end of the resistor $R_{EXT}$, is coupled to the ground GND. A positive input terminal of the comparator 242 is coupled to a reference voltage $V_{REF2}$, and a negative input terminal of the comparator 242 is coupled to a common node between the N-type transistor N5 and the resistor $R_{EXT}$. The comparator 242, the N-type transistor N5 and the resistor $R_{EXT}$, can serve as a current source, which is used for generating a reference current $I_{REF}$. Regarding a circuit design, a size of a mapping current can be adjusted according to a size of the transistor. Therefore, if the conducted current of one of the LED units $L_1$-$L_n$, is about to be adjusted, a channel aspect ratio of the corresponding N-type transistor N3 in the current adjusting unit 220 can be individually adjusted. Moreover, the resistor $R_{EXT}$, can be disposed at external of the driving circuit, so that the reference current $I_{REF}$, can be adjusted according to an external adjusting method.

In addition, it should be noticed that the aforementioned N-type transistors are n-channel metal oxide semiconductor field effect transistors (MOSFETs), and the P-type transistors are P-channel metal oxide semiconductor field effect transistors (MOSFETs). Since a source and a drain of a transistor have no difference considering a device structure, the circuit structure of the present invention is not limited to the coupling relations of the sources and drains of the transistors of the above embodiment.

In summary, in the present invention, the N-type transistors and the P-type transistors are used to implement the driving unit, so that application of complicated circuit devices such as the transmission gates is avoided. Therefore, a design area and a fabrication cost of the chip are reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving circuit of a backlight module, wherein the backlight module includes a first light-emitting diode (LED) unit, the driving circuit comprising:

a voltage conversion unit, coupled to a first end of the first LED unit for providing a driving voltage to the first LED unit;

a current adjusting unit, coupled to a second end of the first LED unit for adjusting a conducted current of the first LED unit according to a first current adjusting signal;

a current mapping unit, outputting a reference voltage; and a dimming unit, coupled between the current mapping unit and the current adjusting unit, and comprising a plurality of driving units, wherein a first driving unit outputs the first current adjusting signal according to a first pulse width modulation (PWM) signal, a first enable signal and the reference voltage, wherein the first driving unit comprises:

an AND gate, having a first input terminal and a second input terminal respectively receiving the first PWM signal and the first enable signal;

a N-type transistor, having a drain coupled to the reference voltage, a source coupled to the current adjusting unit and outputting the first current adjusting signal, and a gate coupled to an output terminal of the AND gate; and a P-type transistor, coupled between the reference voltage and ground, and a gate of the P-type transistor being coupled to the output terminal of the AND gate.

2. The driving circuit as claimed in claim 1, wherein the backlight module further comprises a second LED unit coupled between the voltage conversion unit and the current adjusting unit, and a second driving unit in the driving units outputs a second current adjusting signal to the current adjusting unit according to a second PWM signal, a second enable signal and the reference voltage, so as to adjust a conducted current of the second LED unit.

3. The driving circuit as claimed in claim 2, wherein the second driving unit and the first driving unit have a same circuit structure.

4. The driving circuit as claimed in claim 1, wherein the voltage conversion unit comprises a boost circuit.

5. The driving circuit as claimed in claim 1, wherein the current adjusting unit comprises:

a first N-type transistor, having a drain coupled to the second end of the first LED unit;

a second N-type transistor, having a drain coupled to a source of the first N-type transistor, a source coupled to the ground, and a gate coupled to the source of the N-type transistor of the first driving unit;

a comparator, having a positive input terminal coupled to a first reference voltage, and an output terminal coupled to a gate of the first N-type transistor; and a third N-type transistor, having a drain coupled to a negative input terminal of the comparator, a source coupled to a common node of the first N-type transistor and the second N-type transistor, and a gate coupled to the drain of the third N-type transistor.

6. The driving circuit as claimed in claim 1, wherein the current adjusting unit comprises:

a first N-type transistor, having a drain coupled to the second end of the first LED unit;

a second N-type transistor, having a drain coupled to a source of the first N-type transistor, and a source coupled to the ground;

a comparator, having a positive input terminal coupled to a reference voltage, and an output terminal coupled to a gate of the first N-type transistor; and a resistor, coupled between a negative input terminal of the comparator and the source of the first N-type transistor.

7. The driving circuit as claimed in claim 1, further comprising:

a voltage detecting unit, coupled between the second end of the LED unit and the voltage conversion unit, for detecting a voltage of the second end, so as to adjust the driving voltage output by the voltage conversion unit.

8. The driving circuit as claimed in claim 1, wherein the current mapping unit comprises:

a first P-type transistor, having a source coupled to a voltage source, and a gate coupled to a drain of the first P-type transistor;

a second P-type transistor, having a source coupled to the voltage source, a drain coupled to the ground, and a gate coupled to the gate of the first P-type transistor;

a first N-type transistor, having a drain coupled to the drain of the first P-type transistor;

a resistor, coupled between a source of the first N-type transistor and the ground; and a comparator, having a positive input terminal coupled to a first reference voltage, a negative input terminal coupled to the source of the first N-type transistor, and an output terminal coupled to a gate of the first N-type transistor, wherein the first P-type transistor and the second P-type transistor form a current mirror, and the gate of the first P-type transistor outputs the reference voltage.

9. The driving circuit as claimed in claim 1, wherein the LED unit comprises a plurality of LEDs, wherein the LEDs are connected in serial.

* * * * *